US007207113B2

(12) United States Patent
Yeh

(10) Patent No.: US 7,207,113 B2
(45) Date of Patent: Apr. 24, 2007

(54) COMBINATION HAIRDRESSING SCISSOR ASSEMBLY

(76) Inventor: Wen-Ya Yeh, 15F-2, No. 18, Chorng Shyue Road, Tainan (TW) 70156

( * ) Notice: Subject to any disclaimer, the term of this patent is extended or adjusted under 35 U.S.C. 154(b) by 0 days.

(21) Appl. No.: 11/195,191

(22) Filed: Aug. 2, 2005

(65) Prior Publication Data

US 2006/0150425 A1 Jul. 13, 2006

Related U.S. Application Data

(62) Division of application No. 11/034,669, filed on Jan. 12, 2005.

(51) Int. Cl.
*B26B 13/00* (2006.01)

(52) U.S. Cl. ..... 30/226; 30/254

(58) Field of Classification Search ..... 30/195, 30/196, 197, 226, 227, 254, 260; 24/594.1, 24/594.11, 595.1, 629, 662, 664, DIG. 38, 24/DIG. 43, DIG. 50; D8/5, 57
See application file for complete search history.

(56) References Cited

U.S. PATENT DOCUMENTS

| | | | | |
|---|---|---|---|---|
| 3,734,551 | A * | 5/1973 | Hughes et al. | 292/17 |
| 5,875,553 | A * | 3/1999 | Geib et al. | 30/226 |
| 5,898,172 | A * | 4/1999 | Masui et al. | 250/239 |
| 5,996,592 | A * | 12/1999 | Choy | 30/226 X |
| 6,182,338 | B1 * | 2/2001 | Watanabe | 24/662 X |
| 6,192,590 | B1 | 2/2001 | Yeh | |
| 6,434,833 | B1 | 8/2002 | Yeh | |
| 6,487,759 | B1 * | 12/2002 | Akeno et al. | 24/629 X |
| 6,557,263 | B1 * | 5/2003 | Yeh | 30/226 |
| 6,601,304 | B2 * | 8/2003 | Yeh | 30/226 |
| 6,634,106 | B2 * | 10/2003 | Yeh | 30/226 |
| 6,748,662 | B2 * | 6/2004 | Yeh | 30/226 |
| 6,990,739 | B2 * | 1/2006 | Yeh | 30/226 |
| 2003/0051349 | A1 * | 3/2003 | Yeh | 30/254 |
| 2003/0079352 | A1 * | 5/2003 | Yeh | 30/226 |
| 2004/0078982 | A1 * | 4/2004 | Yeh | 30/226 |
| 2004/0255469 | A1 * | 12/2004 | Yeh | 30/226 |
| 2006/0150424 | A1 * | 7/2006 | Yeh | 30/226 |

FOREIGN PATENT DOCUMENTS

| | | |
|---|---|---|
| EP | 1 491 301 A1 | 12/2004 |
| GB | 2 337 721 A | 12/1999 |

* cited by examiner

*Primary Examiner*—Clark F. Dexter
(74) *Attorney, Agent, or Firm*—Pro-Techtor Int'l Services

(57) ABSTRACT

A combination hairdressing scissor assembly comprises a plurality of male connecting members and a plurality of female connecting members symmetrically provided at two opposite sides of each pair of hairdressing scissors for enabling plural pairs of hairdressing scissors to be connected in parallel by fastening the male connecting members of one pair of hairdressing scissors into the female connecting members of another pair of hairdressing scissors, each female connecting member having two clamping arms and two elastic stop strips connected between the clamping arms at top and bottom sides for securing the respective male connecting member in place upon insertion of the respective male connecting member into the opening between the clamping arms.

4 Claims, 7 Drawing Sheets

COMBINATION HAIRDRESSING SCISSOR ASSEMBLY

This application is a division of application Ser. No. 11/034,669, filed Jan. 12, 2005.

BACKGROUND OF THE INVENTION

1. Field of the Invention

The present invention relates to hairdressing scissors and more particularly, to a combination hairdressing scissor assembly.

2. Description of the Related Art

FIG. 1 is an exploded view of a hairdressing scissor assembly according to U.S. Pat. No. 6,434,833, which is an invention of the present inventor. According to this design, the first and second cutting members 10, 20 of each scissor 1 have sleeves 13 and 23 and engaging members 15 and 25 symmetrically disposed at two opposite sides. By engaging the engaging members 15 and 25 at one scissor 1 into the sleeves 13 and 23 at the other scissor 1, two scissors 1 are secured together. This design of hairdressing scissor assembly is still not satisfactory in function. Because the connection between the respective engaging members 15 and 25 and the respective sleeves 13 and 23 is a "sleeve joint", the respective engaging members 15 and 25 may easily be separated from the respective sleeves 13 and 23 by an accident. Further, because same pitch is provided between each two scissors, the scissors cannot be adjusted to achieve a stepped cutting subject to the shape and amount of hair of different clients, showing a stepped sense of beauty.

SUMMARY OF THE INVENTION

The present invention has been accomplished under the circumstances in view.

It is the main object of the present invention to provide a combination hairdressing scissor assembly, which allows a plural pairs of hairdressing scissors to be connected in parallel at same or different elevations to fit different hair trimming requirements.

It is another object of the present invention to provide a combination hairdressing scissor assembly, which keeps pairs of hairdressing scissors connected in parallel at a different pitch to fit different hair cutting requirements.

According to one aspect of the present invention, the combination hairdressing scissor assembly comprises a plurality of male connecting members and a plurality of female connecting members symmetrically provided at two opposite sides of each pair of hairdressing scissors for enabling plural pairs of hairdressing scissors to be connected in parallel by fastening the male connecting members of one pair of hairdressing scissors into the female connecting members of another pair of hairdressing scissors. Each female connecting member has two clamping arms, an opening defined between the clamping arms, and two elastic stop strips connected between the clamping arms at top and bottom sides of the opening. Each male connecting member has a height smaller than the height of the opening between the elastic stop strips of each female connecting member. By means of inserting the male connecting member into the opening of the corresponding female connecting member to expand the clamping arms, the male connecting member is firmly secured to the corresponding female connecting member.

According to another aspect of the present invention, the male connecting members and the female connecting members can be provided at same or different elevations such that the pairs of hairdressing scissors can be connected in parallel at same or different elevations.

According to still another aspect of the present invention, the male connecting members or female connecting members can be prepared at different sizes such that the pairs of hairdressing scissors are kept spaced from one another at a different pitch to fit different hair cutting requirements when connected together.

DETAILED DESCRIPTION OF THE PREFERRED EMBODIMENTS

Figure 1:
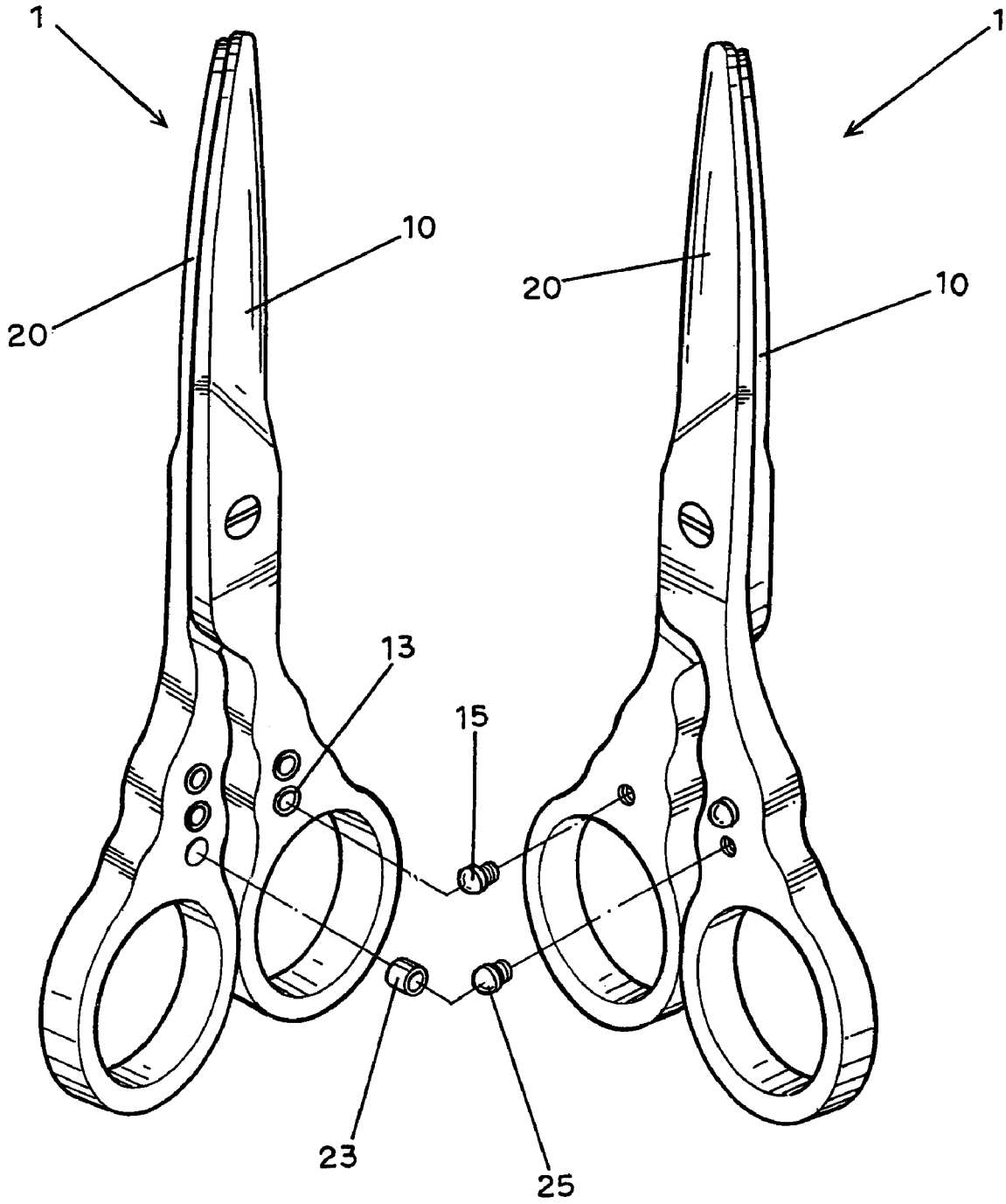
FIG. 1(Prior Art)
FIG. 1 is an exploded view of a hairdressing scissor assembly according to U.S. Pat. No. 6,434,833.
Figure 2:
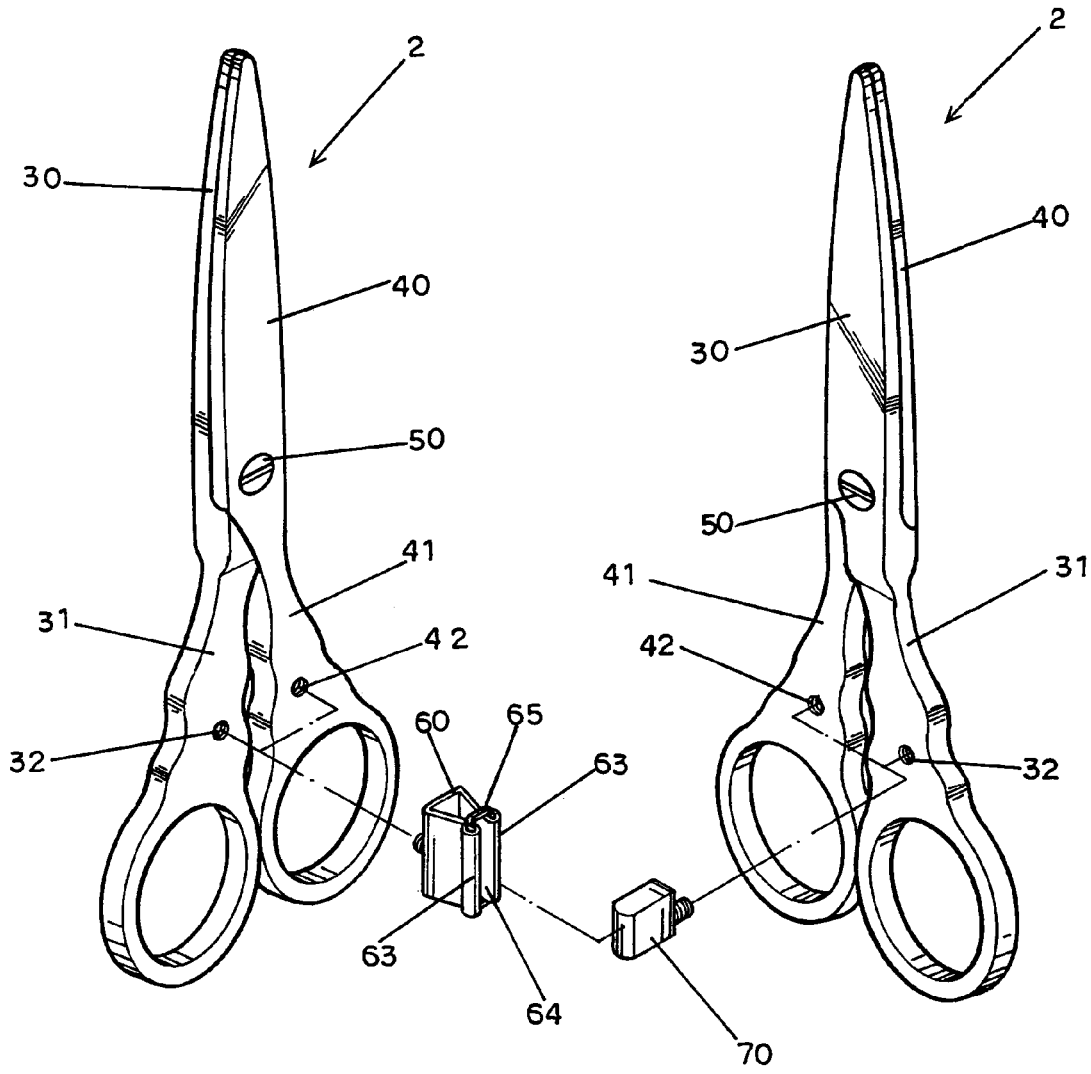
FIG. 2 is an exploded view of a combination hairdressing scissor assembly according to a first embodiment of the present invention.
Figure 3:
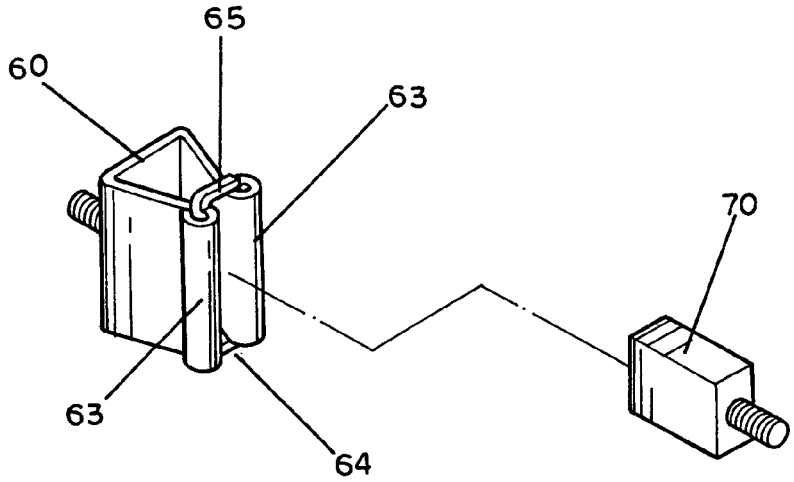
FIG. 3 is a perspective view of a female connecting member and a male connecting member for the combination hairdressing scissor assembly according to the first embodiment of the present invention.
Figure 4:
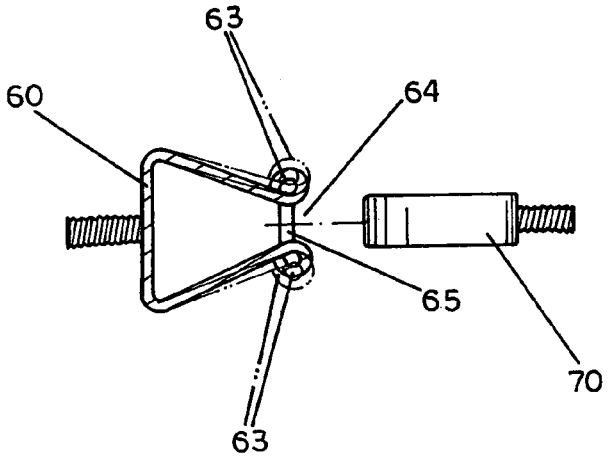
FIG. 4 is top view in section of FIG. 3.
Figure 5:
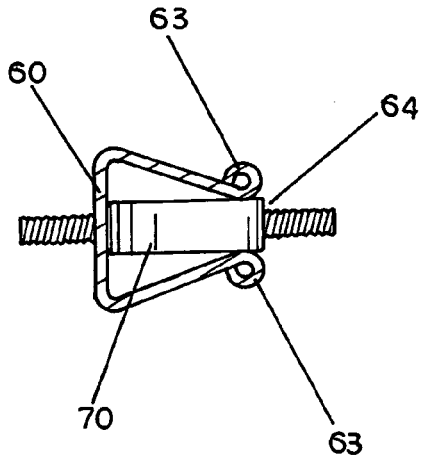
FIG. 5 corresponds to FIG. 4, showing the male connecting member fastened to the female connecting member.
Figure 6:
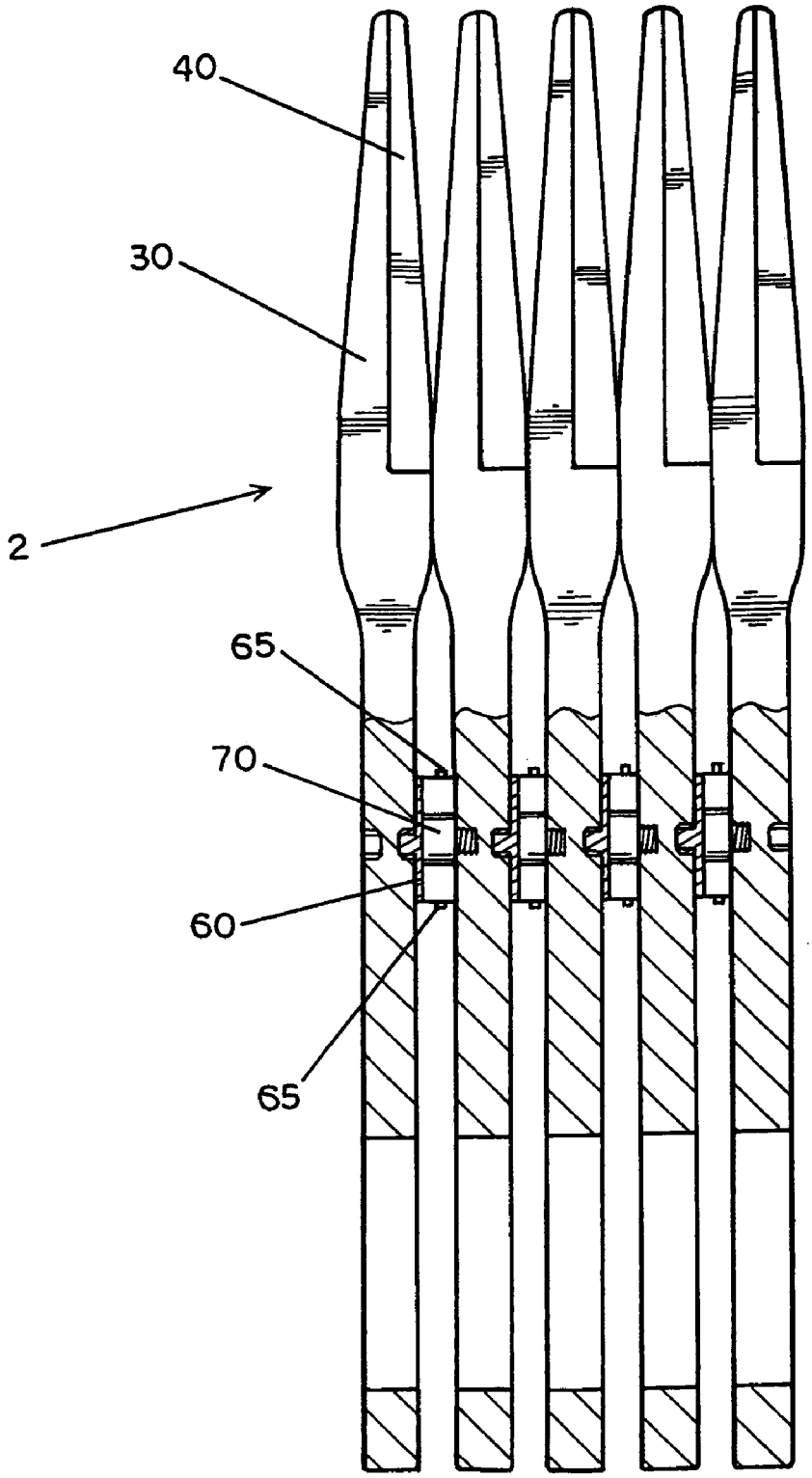
FIG. 6 a sectional view showing plural pairs of hairdressing scissors connected in parallel at the same elevation according to the first embodiment of the present invention.
Figure 7:
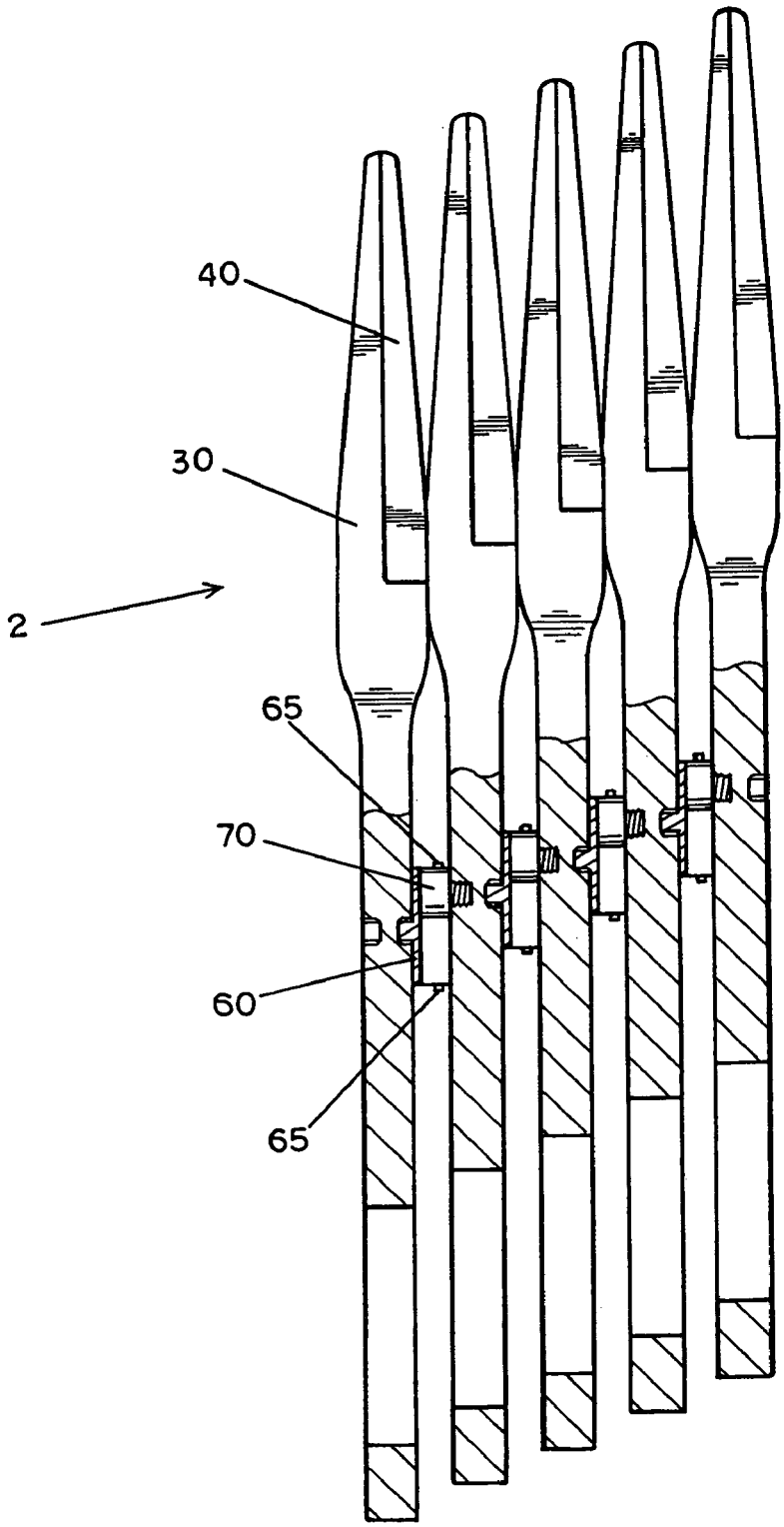
FIG. 7 is a sectional view showing plural pairs of hairdressing scissors connected in parallel at different elevations according to the first embodiment of the present invention.

Referring to FIGS. 2 and 3, a combination hairdressing scissor assembly in accordance with the first embodiment of the present invention is shown comprising pairs of hairdressing scissors 2 each having first and second cutting members 30 and 40 that are pivoted together by a pivot 50. The first cutting member 30 comprises a first handle 31 on an end thereof. The second cutting member 40 comprises a second handle 41 on an end thereof. The first handle 31 and the second handle 41 each comprise at least one screw hole 32 or 42 at each of the two opposite sides thereof. Male connecting members 70 and female connecting members 60 are respectively fastened to the screw holes 32 and 42 of the handles 31 and 41 of the first and second cutting members 30 and 40 at two opposite side. The female connecting member 60 is a hollow triangular frame member having two clamping arms 63, an opening 64 defined between the clamping arms 63, and two elastic stop strips 65 connected between the clamping arms 63 at top and bottom sides of the opening 64. The male connecting member 70 has a height smaller than the height of the opening 64 between the elastic stop strips 65.

According to this embodiment, the female connecting member 60 and the male connecting member 70 are respectively fastened to a respective screw hole 42 or 32. Alternatively, the female connecting member 60 and the male connecting member 70 can be respectively fastened to the handle 41 or 31 through a plug joint, by means of the application of an adhesive, by welding, or by means of any of a variety of conventional techniques.

Referring to FIGS. 4~7, by means of inserting the male connecting member 70 into the opening 64 of the corresponding female connecting member 60 to expand the clamping arms 63, the male connecting member 70 is firmly secured to the corresponding female connecting member 60. Therefore, by means of fastening the male connecting members 70 at one pair of scissors to the female connecting members 60 at another pair of scissors, plural pairs of scissors 2 are connected in parallel at the same elevation (see FIG. 6) or at different elevations (see FIG. 7).

Figure 8:
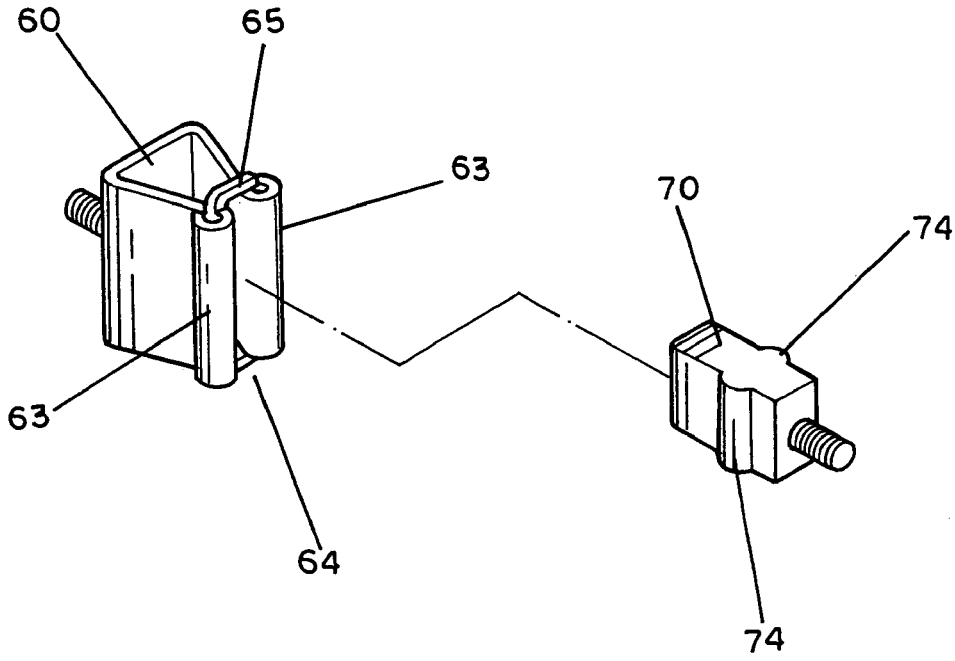
FIG. 8 is a perspective view of a female connecting member and a male connecting member for the combination hairdressing scissor assembly according to a second embodiment of the present invention.
Figure 9:
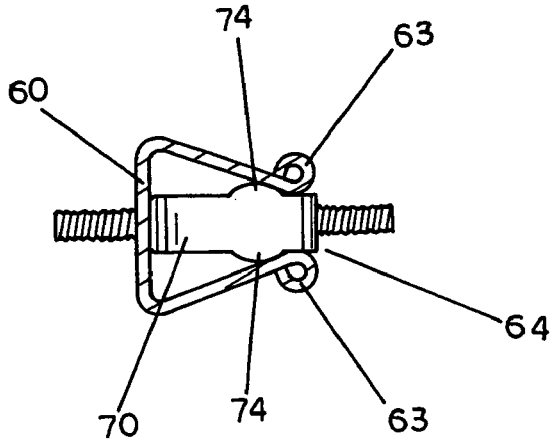
FIG. 9 is a sectional assembly view of FIG. 8.

FIG. 8 is a perspective view of a female connecting member and a male connecting member for the combination hairdressing scissor assembly according to a second embodiment of the present invention. FIG. 9 is a sectional assembly view of FIG. 8. According to this second embodiment, the female connecting member 60 is same as the aforesaid first embodiment. However the male connecting member 70 according to this second embodiment has two convex portions 74 at two sides that enhance engagement between the female connecting member 60 and the corresponding male connecting member 70.

Figure 10:
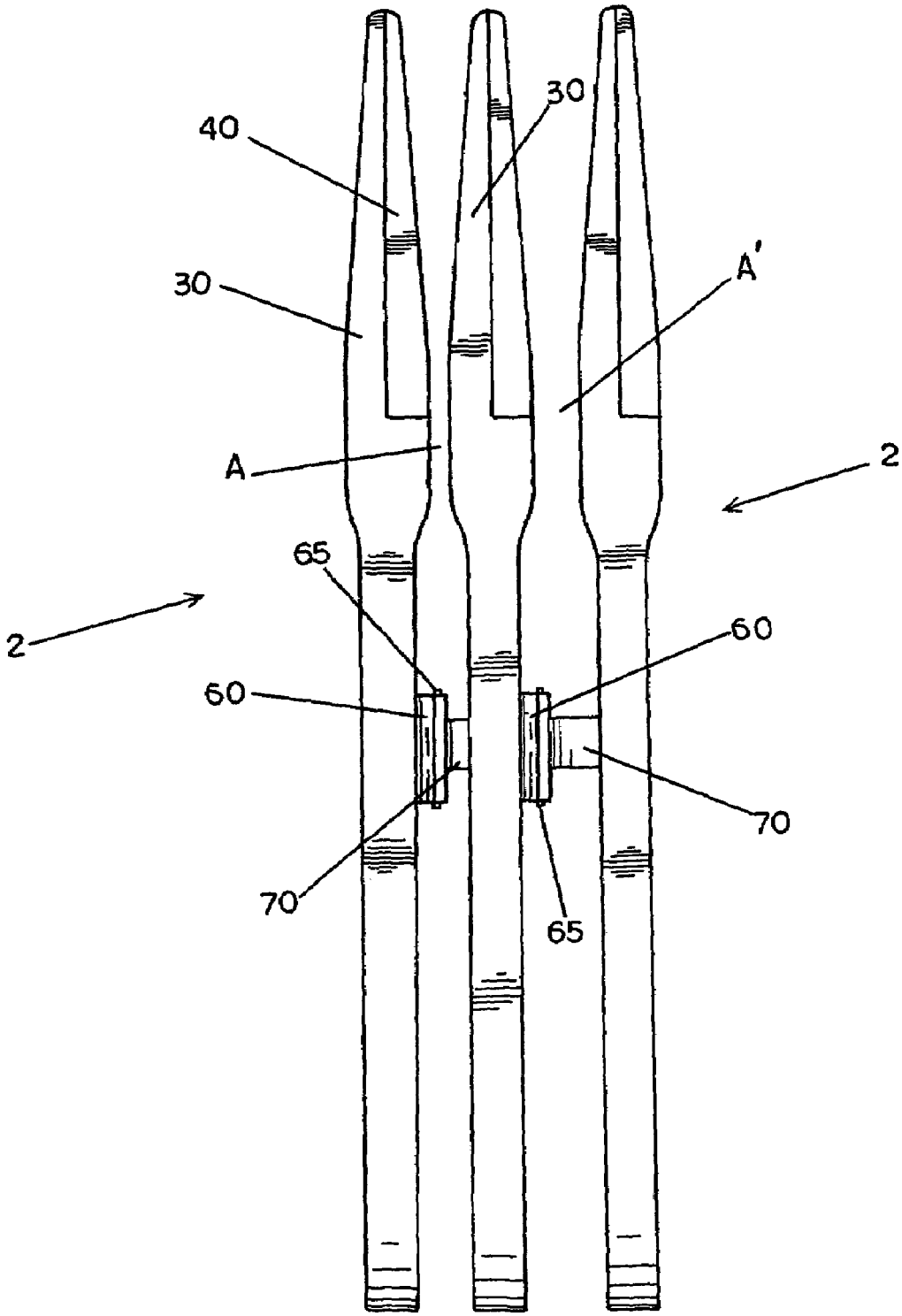
FIG. 10 is a sectional view showing plural pairs of hairdressing scissors connected in parallel at the same elevation and spaced from one another at a different pitch according to the aforesaid embodiments of the present invention.

FIG. 10 is a sectional view showing plural pairs of hairdressing scissors connected in parallel at the same elevation and spaced from one another at a different pitch according to the aforesaid embodiments of the present invention.

As indicated above, the invention has the following features:

1. By means of inserting the male connecting member 70 into the opening 64 of the corresponding female connecting member 60 to expand the clamping arms 63, the male connecting member 70 is firmly secured to the corresponding female connecting member 60, and plural pairs of hairdressing scissors 2 are connected in parallel for operation with one single hand.

2. By means of the use of different lengths of male connecting members 70, the pitch A or A' between each two adjacent pairs of hairdressing scissors 2 is relatively changed to fit different cutting requirements.

3. The male connecting member 70 can be moved vertically relative to the female connecting member 60 after its insertion into the an opening 64, and then secured to the female connecting member 60 in position by the clamping arms 63, such that a plural pairs of the hairdressing scissors 2 can be fastened together in parallel at same or different elevations for operation with one single hand to trim the hair.

Although particular embodiments of the invention have been described in detail for purposes of illustration, various modifications and enhancements may be made without departing from the spirit and scope of the invention.

What the invention claimed is:

1. A combination hairdressing scissor assembly comprising:

a plurality of hairdressing scissors, each having a first side and an opposite side, each comprising two cutting members pivotally connected together, each of said cutting members having a handle and a cutting end;

at least one male connecting member disposed on a first side of at least one of said scissors; and at least one female connecting member symmetrically disposed on a respective opposite side of at least another one of said hairdressing scissors, each said female connecting member comprising two opposed clamping arms forming an elongate opening defined between said opposed clamping arms;

wherein said hairdressing scissors are releasably connected together in parallel by inserting said male connecting members, with motion perpendicular to said respective handle, into one of the elongate openings between the clamping arms of one of the respective female connecting members and secured to the respective female connecting members by the clamping arms of the respective female connecting members; and wherein each said female connecting member further comprises two elastic stop strips connected between the respective clamping arms, one of the stop strips connecting the clamping arms respectively at top and bottom sides of the elongate opening.

2. The combination hairdressing scissor assembly as claimed in claim 1, wherein each said male connecting member has two convex portions disposed respectively at two sides for stopping against a respective inner wall of the two clamping arms of the respective female connecting member.

3. The combination hairdressing scissor assembly as claimed in claim 1, wherein said male connecting members have a height smaller than the height of the elongate opening of each said female connecting members between the elastic stop strips of each said female connecting member, whereby said hairdressing scissors are enabled to be fastened in parallel at different elevations.

4. The combination hairdressing scissor assembly as claimed in claim 1, wherein at least three hairdressing scissors are connected together, and wherein the at least one male connecting member connecting two of the scissors together have a different length than the at least one male connecting member connecting another two of the scissors together, whereby said hairdressing scissors are enabled to be fastened in parallel at a different pitch.

* * * * *